US005249435A

United States Patent [19]

Lever et al.

[11] Patent Number: 5,249,435

[45] Date of Patent: Oct. 5, 1993

[54] REFRIGERATION FOR FOOD SERVICE

[75] Inventors: Jeff Lever, Lexington; Andy Burrows, Columbia, both of S.C.

[73] Assignee: Food Service Supplies, Inc., Columbia, S.C.

[21] Appl. No.: 868,731

[22] Filed: Apr. 14, 1992

[51] Int. Cl.[5] ..... F25D 17/06; A47F 3/04

[52] U.S. Cl. ..... 62/419; 62/249; 62/253; 62/258; 62/417; 312/405

[58] Field of Search ..... 62/249, 252–255, 62/258, 265, 337, 237, 417, 419, 448; 312/139.1, 322, 405

[56] References Cited

U.S. PATENT DOCUMENTS

| | | | |
|---|---|---|---|
| 1,644,675 | 10/1927 | Huening | 312/139.1 X |
| 1,879,241 | 9/1932 | Hill | 62/249 |
| 1,898,560 | 2/1933 | Mezzapesa | 62/249 |
| 2,407,159 | 9/1946 | Jones | 62/417 X |
| 2,437,257 | 3/1948 | Johnson | 62/258 X |
| 2,438,355 | 3/1948 | Wilson | 62/258 X |
| 2,465,142 | 3/1949 | Wisler | 62/258 X |
| 2,465,459 | 3/1949 | Kolin | 62/337 X |
| 2,786,337 | 3/1957 | Spring | 62/258 |
| 3,010,290 | 11/1961 | Fredrick | 62/251 |
| 4,019,339 | 4/1977 | Anderson | 62/255 |
| 4,505,131 | 3/1985 | Boxall | 62/417 X |
| 4,685,311 | 8/1987 | Rastelli | 62/258 |
| 4,802,340 | 2/1989 | Johnson | 62/255 X |
| 4,930,409 | 6/1990 | Stefanakis | 99/484 |

FOREIGN PATENT DOCUMENTS

| | | | |
|---|---|---|---|
| 224665 | 12/1962 | Fed. Rep. of Germany | 312/139.1 |
| 0089981 | 3/1990 | Japan | 62/265 |

*Primary Examiner*—Henry A. Bennet
*Assistant Examiner*—Christopher B. Kilner
*Attorney, Agent, or Firm*—Michael A. Mann

[57] ABSTRACT

A refrigerator for food service. The refrigerator has a housing with two openings for one insert each, preferably a basket for holding several flats of eggs in one and a well for holding batter in the other. The opening for the basket is preferably oriented at an angle for easier access to its interior. The housing has an air conditioning unit located below it or located remotely but in fluid communication with the interior of the housing. A fan on the interior circulates the chilled air throughout the housing. The lid for the egg basket has one closed position and two opened positions. To open the basket lid, it can be either rotated on two pins up and back or raised to the horizontal and pushed back into a hollow area at the top of the housing, its two pins sliding in channels formed in the housing.

15 Claims, 2 Drawing Sheets

REFRIGERATION FOR FOOD SERVICE

BACKGROUND OF THE INVENTION

1. Field of the Invention

The present invention relates to refrigerators for food products. More specifically, the present invention relates to refrigerators for storing foods convenient to food preparers.

2. Discussion of Background

Food service in restaurants must be efficient. In particular, food must be prepared quickly and properly, and ingredients must be fresh both for better taste and for health reasons. Refrigeration helps maintain the freshness of many food items and is required for such perishable items as, for example, eggs.

In many restaurants, the level of business varies considerably during the typical day, and can include periods of greatly heightened activity during meal times. In order to prepare food items, there has to be a convenient supply of the items to be prepared. Yet, many items require refrigeration until just prior to preparation. If a supply of food items taken from a refrigerator to the food preparation area is more than needed, some food will be wasted as the leftover items are discarded. If the supply of food items taken to the food preparation area is less than needed, there may be delays in service as the exhausted supply is replenished.

Other food storage devices exist See, for example, the devices described in U.S. Pat. No. 4,930,409 issued to Stefanakis and U.S. Pat. No. 4,685,311 issued to Rastelli.

There remains a need for an apparatus that maintains food such as eggs at an appropriate temperature so that bacterial formation is retarded and which can be incorporated into a food preparation area with minimum difficulty and contribute to the efficient preparation of the food.

SUMMARY OF THE INVENTION

According to its major aspects and broadly stated, the present invention is an apparatus for storing food items comprising a frame with a housing attached to it and an air conditioning system to provide chilled air to the housing. The chiller can be self-contained or remote. The housing has an interior and a top surface having two openings, one for a well to hold batter (egg wash) for French toast, for example, and a second opening for a basket to hold several flats of eggs. Each opening has a lid. The lid for the basket has two opened positions, one rotated open for temporary access to the interior of the housing and one slid into a hollow region in the top surface of the housing. The first lid and opening are oriented at an angle with respect to the otherwise horizontal top surface to hold the basket at an angle so that the user can see into and reach into the basket for eggs. The air conditioner chills air for delivery to the housing and circulation throughout its interior by means of a fan.

The combination of the egg basket and well for a batter, such as French toast batter, is an important feature of the present invention. Both are typically used in preparing breakfasts in restaurants and both need to be refrigerated. Therefore, collocation of these food items enables one refrigerator system to chill both efficiently.

Another important feature is the orientation of the egg basket. This enables the food preparer to see the eggs at a glance and easily select the number needed.

Yet another important feature of the present invention is the lid for the egg basket. The lid has one closed position and two open positions: one rotated up and back from the opening and the other where the lid is pushed into a hollow portion of the housing. If the lid is to be opened for a relatively short period of time, the rotated open position is used. However, if the lid is to remain open for a longer period of time and in particular if the top of the housing is to be used as a shelf, the second opened position is preferred.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
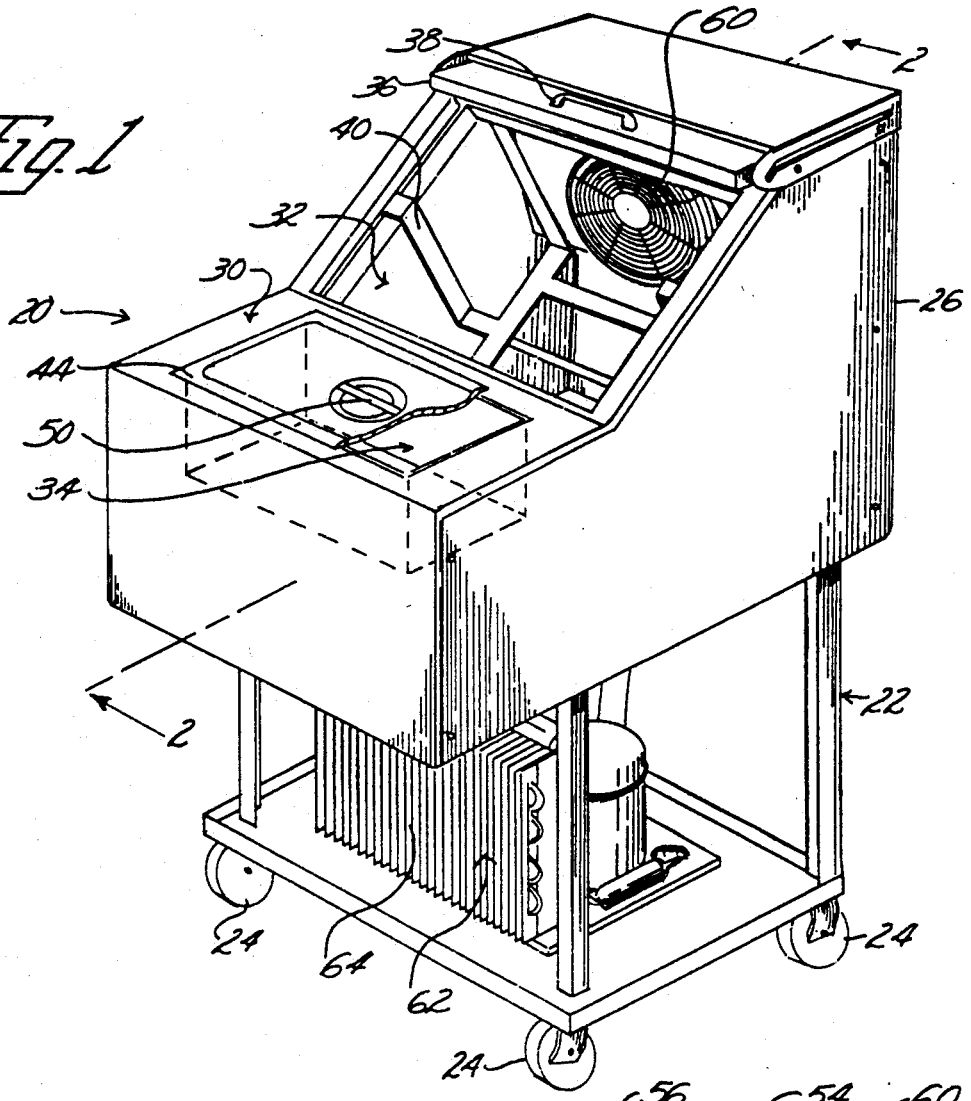
FIG. 1 is a perspective view of a refrigerator according to a preferred embodiment of the present invention.
Figure 2:
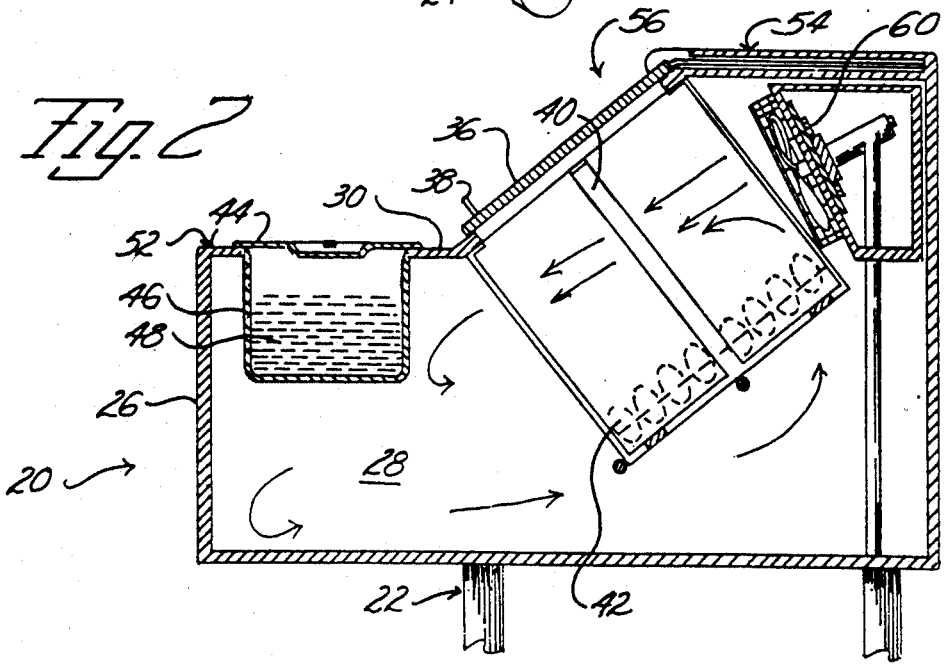
FIG. 2 is a side cross sectional view of the refrigerator shown in FIG. 1 taken along lines 2—2.
Figure 3:
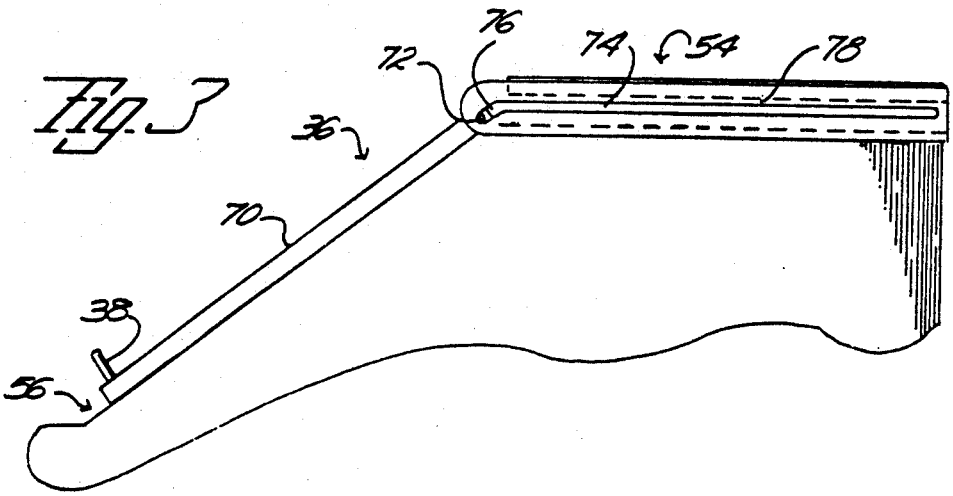
FIG. 3 is a partial, side detail view of the lid of the refrigerator of FIG. 1.

Referring now to FIGS. 1 and 2, there is shown in perspective a refrigerator for food service according to a preferred embodiment of the present invention. The refrigerator, generally designated by the reference numeral 20, comprises a frame 22, optionally with a set of wheels 24 for mobility, and a housing 26 carried by frame 22.

Housing 26 has an interior 28 and a top surface 30 with two openings, a first opening 32 and a second opening 34. First opening 32 has a lid 36 with a handle 38 and is dimensioned to receive a basket 40 large enough to hold a supply of the food item to be kept at low temperature. As illustrated in FIGS. 1 and 2, basket 40 is preferably in the form of an open framework for holding food items or a food container. Such an item may be egg flats, for example, as shown or other items. Basket 40 is dimensioned to hold four flats of eggs 42 and is supported by housing 26.

Second opening 34 also has a lid 44 is dimensioned to hold a well 46 for liquids 48 such as batters for French toast and is also supported by housing 26. Lid 44 has a handle 50.

Top surface 30 is formed to have two levels, lower level 52 and upper level 54, separated by an angled portion 56 so that basket 40 is oriented at an angle with respect to the horizontal and well 46. Orienting basket 40 at an angle so that its interior is visible to a standing food preparer makes selecting a food item easier.

At one end of housing 26, in interior 28, is an electric fan 60 for directing air through basket 40 and throughout interior 28 to chill its contents.

Below housing 26 is a typical air conditioning unit 62 with a radiator 64 for radiating heat picked up by the working fluid in the air conditioning system. Unit 62 is in fluid communication with interior 28 of housing 26 to deliver chilled air to interior 28. Thus, chilled air is supplied to interior 28 of housing 26 by unit 62. The chilled air circulates through basket 40 and across any items contained therein, directed by electric fan 60. Basket 40 may hold egg flats as shown in FIG. 2. Alternatively, basket 40 may hold other food storage containers that are suitably dimensioned to be supported by the framework of basket 40.

FIGS. 3, 4*a*, 4*b*, 4*c* and 5 depict the movement of lid 36. Lid 36 comprises a flat portion 70 dimensioned to cover first opening 32, handle 38 and a pin 72 on each side of flat portion 70 (one visible in the figures). Housing 26 has a channel 74 formed on each side of upper lever 54, pin 72 riding slidably and rotatably in channel 74. Channel 74 has a "dog-leg" 76 near angled portion 56 of top surface 30. When in its closed position (FIG. 3), lid 36 rests on top surface 30 with pin 72 at the extreme end of channel 74, in dog leg portion 76.

Figure 4A:
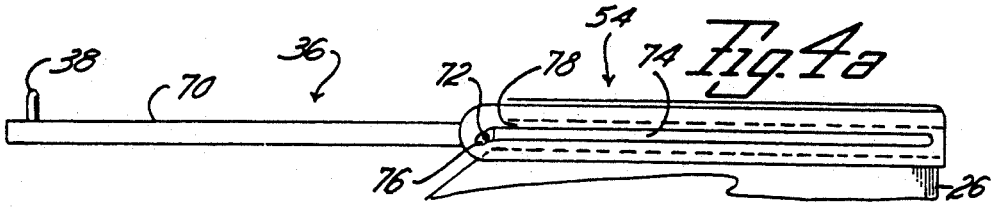
FIGS. 4*a*, 4*b* and 4*c* are partial, side detail views of the lid of the refrigerator of FIG. 1 showing a way the lid can be opened for access to the interior of the refrigerator.
Figure 4B:
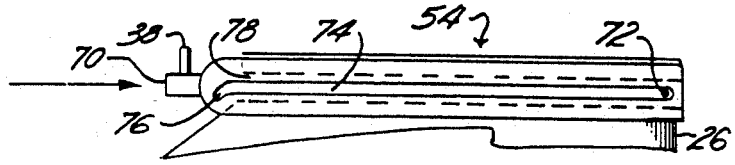
Figure 4C:
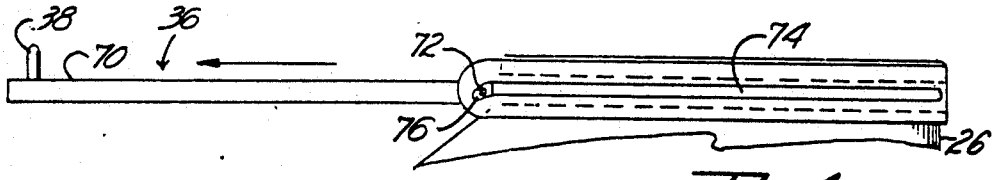
Figure 5:
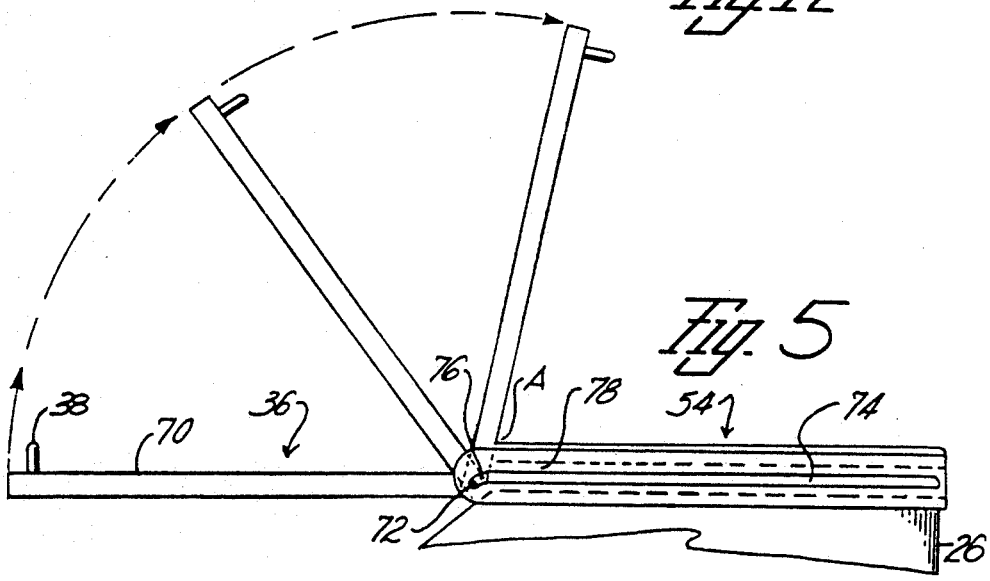
FIG. 5 is a partial, side detail view of the lid of the refrigerator of FIG. 1 showing another way the lid can be opened for access to the interior of the refrigerator.

To put lid 36 into one of its opened positions, flat portion 70 is raised until it is horizontal (FIG. 4*a*) and then pushed into a hollow area 78 inside housing guided by the sliding of pin 72 in channel 74 as indicated by the arrow in FIG. 4*b*. Top surface 30 can be used as a shelf as lid 36 remains open and out of the way.

For more temporary openings, lid 36 is rotated about pin 72, pin 72 otherwise remaining in its position in channel 74, until flat portion 70 rests against top surface 30 at upper level 54 at A at the limit of its rotation.

Other types of inserts can be substituted for well 46 and basket 40, depending on what is being stored. In use, refrigerator 20 is positioned preferably between a charcoal broiler and a griddle so that its food items are easily accessible to the food preparer. Air conditioning unit 62 is switched on to begin delivering cool air to interior 28 of housing 26. Lid 36 is slid into housing 26 and lid 44 is placed on top surface 30 at upper level 54. Basket 40 is loaded with several flats of eggs and inserted into first opening 32. Well 46 is filled with batter and inserted into second opening 34. Cooking can then begin.

It will be apparent to those skilled in the art that many changes and substitutions can be made to the preferred embodiment herein described without departing from the spirit and scope of the present invention as defined by the appended claims.

What is claimed is:

1. An apparatus for storing food items, said apparatus comprising:

a housing having an interior and at least one opening;

means for providing chilled air to said interior;

means carried by said housing for holding a supply of said food items so that said chilled air circulates through said holding means, said holding means located near said opening; and at least one lid carried by said housing for covering said at least one opening, each lid dimensioned and positioned to cover one of said at least one openings, one of said at least one lid having a first open position, a second open position and closed position.

2. The apparatus as recited in claim 1, wherein said holding means further comprises:

insert means dimensioned for fitting into said at least one opening; and means formed in said housing along the edge of said at least one opening for supporting said insert means.

3. The apparatus as recited in claim 1, wherein said at least one opening further comprises a first opening and a second opening, said holding means located near said first opening, and wherein said at least one lid further comprises a first lid and a second lid, said first lid dimensioned and positioned to cover said first opening and said second opening dimensioned and positioned to be covered by said second lid, said first lid having said closed position, said first opened position and said second opened position.

4. The apparatus as recited in claim 1, wherein said at least one opening further comprises a first opening and a second opening, said holding means located near said first opening, and wherein said at least one lid further comprises a first lid and a second lid, said first lid dimensioned and positioned to cover said first opening and said second opening dimensioned and positioned to be covered by said second lid, said first lid having said closed position, said first opened position and said second opened position, said housing further comprising means formed within said housing to receive said lid when said lid is in said second opened position.

5. The apparatus as recited in claim 1, wherein said at least one opening further comprises a first opening and a second opening, said holding means located near said first opening, and wherein said at least one lid further comprises a first lid and a second lid, said first lid dimensioned and positioned to cover said first opening and said second opening dimensioned and positioned to be covered by said second lid, said first lid having said closed position, said first opened position and said second opened position, said holding means further comprising a first insert dimensioned to fit into said first opening and a second insert dimensioned to fit into said second opening.

6. The apparatus as recited in claim 1, wherein said at least one opening further comprises a first opening and a second opening, said holding means located near said first opening, and wherein said at least one lid further comprises a first lid and a second lid, said first lid dimensioned and positioned to cover said first opening and said second opening dimensioned and positioned to be covered by said second lid, said first lid having said closed position, said first opened position and said second opened position, said holding means further comprising a basket dimensioned to fit into said first opening and a well dimensioned to fit into said second opening, said basket dimensioned to hold at least one flat of eggs.

7. An apparatus for storing food items, said apparatus comprising:

a housing having an interior, a first opening and a second opening;

means for providing chilled air to said interior;

a first insert supported by said housing and dimensioned to fit into said first opening, said first insert adapted to allow said chilled air to circulate therethrough;

a second insert supported by said housing and dimensioned to fit into said second opening; and a first lid carried by said housing and dimensioned to cover said first opening, said first lid having a first open position, a second open position and closed position;

a second lid carried by said housing and dimensioned to cover said second opening; and means formed in said housing for receiving said first lid when said first lid is in said first opened position.

8. The apparatus as recited in claim 7, wherein said first insert is a basket dimensioned to hold at least one flat of eggs and said second insert is a well for holding liquids.

9. The apparatus as recited in claim 7, wherein said providing means further comprises a fan and an air conditioner, said fan mounted within said housing and directing air chilled by said air conditioner throughout said interior of said housing, and said air conditioner mounted outside said housing and in fluid communication with said interior of said housing so that said chilled air can be directed to said interior.

10. An apparatus for storing food items, said apparatus comprising:

a frame;

a housing attached to said frame having a top surface, an interior, a first opening and a second opening;

an air conditioner carried by said frame and in fluid communication with said interior of said housing so that air chilled by said air conditioner can be delivered to said interior;

a basket supported by said housing so that chilled air can circulate through said basket and dimensioned to fit into said first opening;

a well supported by said housing and dimensioned to fit into said second opening;

a first lid carried by said housing and dimensioned to cover said first opening, said first lid having a first open position, a second open position and closed position, said housing formed to orient said first opening at an angle with respect said top surface of said housing; and a second lid carried by said housing and dimensioned to cover said second opening.

11. The apparatus as recited in claim 10, wherein said housing further comprises a fan for flowing said chilled air throughout said housing.

12. The apparatus as recited in claim 10, said first lid further comprises a pair of pins at one end and said housing has a pair of channels formed therein, said channels holding said pins, said pins free to slide and rotate within said channels so that said first lid can be rotated about said pins to said second open position and received by said housing when said pins slide within said channels.

13. The apparatus as recited in claim 7, wherein said housing has a top surface, and said housing is formed to orient said at least one opening at an angle with respect to said top surface.

14. The apparatus as recited in claim 7, wherein said housing has a top surface, and wherein said housing is formed to support said first insert at an angle with respect to said top surface.

15. The apparatus as recited in claim 10, wherein said housing is formed to support said basket at an angle with respect to said top surface.

* * * * *